US006245479B1

(12) United States Patent
Etzel

(10) Patent No.: US 6,245,479 B1
(45) **Date of Patent: *Jun. 12, 2001**

(54) THERMAL IMAGING MEDIUM

(75) Inventor: Mark R. Etzel, Madison, WI (US)

(73) Assignee: Polaroid Corporation, Cambridge, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/370,284

(22) Filed: Aug. 9, 1999

Related U.S. Application Data

(63) Continuation of application No. 07/435,482, filed on Jun. 5, 1989, which is a continuation-in-part of application No. PCT/US87/03249, filed on Dec. 10, 1987, which is a continuation of application No. 06/939,854, filed on Dec. 9, 1986, now abandoned.

(51) Int. Cl.[7] ..... B41M 1/18; B41M 5/035

(52) U.S. Cl. ..... 430/200; 430/945; 430/201; 430/253; 430/258; 430/259; 430/262; 428/195; 428/204; 428/206; 428/207; 428/220

(58) Field of Search ..... 430/200, 201, 430/945, 253, 258, 259, 262; 428/195, 244, 220, 204, 206, 207, 913, 914

(56) References Cited

U.S. PATENT DOCUMENTS

| | | | |
|---|---|---|---|
| 2,616,961 | 11/1952 | Groak | 178/5.2 |
| 2,630,484 | 3/1953 | Groak | 178/5.2 |
| 3,396,401 | 8/1968 | Nonomura | 346/1 |
| 3,592,644 | 7/1971 | Vrancken et al. | 96/27 |
| 3,787,873 | 1/1974 | Sato et al. | 346/1 |
| 3,924,041 | 12/1975 | Miyayama et al. | 428/212 |
| 3,941,596 | 3/1976 | Heiart | 430/200 |
| 3,975,563 | 8/1976 | Francer et al. | 430/200 |
| 4,004,924 | 1/1977 | Vranken et al. | 430/200 |
| 4,103,053 | 7/1978 | Barehas | 428/914 |
| 4,123,309 | 10/1978 | Perrington et al. | 156/234 |
| 4,157,412 | 6/1979 | Deneau | 428/147 |
| 4,252,879 | 2/1981 | Inoue et al. | 430/9 |
| 4,254,211 | 3/1981 | Scrutton et al. | 430/176 |
| 4,548,857 | 10/1985 | Galante | 428/913 |
| 4,651,172 | 3/1987 | Watanable et al. | 428/913 |
| 4,670,307 | 6/1987 | Onishi et al. | 427/261 |
| 4,686,549 | 8/1987 | Williams et al. | 428/914 |
| 4,702,958 | 10/1987 | Itoh | 428/323 |
| 4,777,159 | 10/1988 | Takaguchi et al. | 428/195 |
| 4,777,492 | 10/1988 | Ohnishi et al. | 346/135.1 |
| 4,788,128 | 11/1988 | Barlow | 430/200 |
| 4,826,717 | 5/1989 | Kohashi et al. | 428/195 |
| 4,840,835 | 6/1989 | Ueyama et al. | 428/212 |
| 4,952,478 | 8/1990 | Miyagawa et al. | 430/253 |
| 4,973,542 | 11/1990 | Takenouchi et al. | 430/253 |
| 5,155,003 | 10/1992 | Chang | 430/200 |

FOREIGN PATENT DOCUMENTS

| | | | |
|---|---|---|---|
| 922666 | 4/1963 | (GB) . | |
| 1353063 | 5/1974 | (GB) . | |
| 1433025 | 4/1986 | (GB) | 430/945 |
| 58-18290 | 2/1983 | (JP) | 430/945 |

OTHER PUBLICATIONS

Brandrup et al., Polymer Handbook, third Edition, vol. V (1989), 82, 83 and 102.

Brinckman et al., Unconventional Imaging Processes, Focal Press (1978), p. 37.

Inoue et al., Thermographic sensor using egg albulin for laser light imaging, SPSE Tokyo Symposium, Sep. 1977, pp. 8–1 to 8–6.

*Primary Examiner*—Martin Angebranndt

(57) ABSTRACT

A high resolution thermal imaging medium including a support web having an image forming surface of a material which may be temporarily liquified by heat and upon which is deposited a particulate or porous layer of an image forming substance which is wettable by the material during its liquified state.

22 Claims, 6 Drawing Sheets

THERMAL IMAGING MEDIUM

REFERENCE TO RELATED APPLICATIONS

This application is a continuation of application Ser. No. 07/435,482, filed Jun. 5, 1989, which is itself a continuation-in-part of PCT/US87/03249, filed Dec. 10, 1987, which is a continuation of application Ser. No. 06/939,854, filed Dec. 9, 1986 now abandoned.

BACKGROUND OF THE INVENTION

1. Field of the Invention

The invention relates generally to a heat mode recording material and, more particularly, to a high resolution thermal imaging medium comprising a heat sensitive layer interacting, at an image-wise application of heat, with an image forming substance for producing images of very high resolution.

2. Description of the Prior Art

Unlike the image processing of conventional photographic materials using silver halide emulsions, thermal imaging media require neither a dark room nor any other protection from ambient light. Instead, images may be produced with thermal imaging media by the application of heat patterns corresponding to the image to be produced and, since these materials can provide images by quicker and simpler processes than those applicable to silver halide materials, they are more convenient and economical than conventional photographic imaging materials. Another consideration which contributes to their desirability is that unlike silver halide materials, thermal imaging media require substantially dry image developing processes and they are unaffected by sustained periods of elevated ambient temperatures. Moreover, thermal imaging media allow the making of more stable images of higher quality because they do not suffer from the image quality drift resulting from the wet processing and temperature effects of silver halide materials.

As thermal imaging media may be used with relative ease and in a potentially wide range of applications, proposals relating to their manufacture and use have not been lacking. One source of heat lately to have become conventional for exposing thermal imaging media are lasers of sufficient power output and appropriately modulated while scanning a medium in an image pattern. The time required for irradiating the medium in this manner is relatively short. Other materials use conventional heat sources such as, for instance, xenon flash tubes.

For instance, U.S. Pat. No. 4,123,309 discloses a composite strip material including an accepting tape comprising a layer of latent adhesive material in face-to-face contact with a layer of microgranules lightly adhered to a donor web. At least one of the layers bears a radiation absorbing pigment, such as carbon black or iron oxide, which when selectively heated in accordance with a pattern of radiation, momentarily softens adjacent portions of the adhesive material sufficiently for the latter completely to penetrate through the pigment. Upon separation of the accepting tape and donor web, microgranules are said to transfer to the accepting tape in the irradiated areas only.

A similar material is disclosed by U.S. Pat. No. 4,123,578.

U.S. Pat. No. 4,157,412 discloses a composite material for forming graphics which includes a layer of latent adhesive material, a mono-layer of granules lightly adhered to a donor web, and a thin layer of bonding material between and in face-to-face contact with layers of granules and adhesive.

The layer of bonding material maintains the adhesive and granular layers in close proximity and excludes air from therebetween. When the composite material is selectively heated in graphic patterns, corresponding portions of the bonding layer melt and corresponding portions of the adhesive material and granular layer soften, absorb the melted portions of the bonding layer and adhere together. Upon subsequent separation of the layer of adhesive and the donor web the remaining portions of the layer of bonding material separate, whereas granules transfer to the accepting tape in the heated areas to provide the graphics.

In U.S. Pat. No. 4,547,456 a heat mode recording material is described which comprises a support and a heat sensitive layer positioned on the support, in which the heat sensitive layer comprises an ionomer resin obtained by ionically cross-linking with at least one metal ion, a copolymer comprising an alpha- olefin and an alpha methylene aliphatic monocarboxylic acid and a hydrophobias binder.

Other materials are known which instead of using a source of heat to provide an image which may be transferred from one layer to another by locally changing the adhesion of photohardenable image forming substances relative to the layers, rely upon actinic radiation for forming images. An example of such a material is disclosed in U.S. Pat. No. 4,247,619.

None of the known thermal imaging materials appear to have found wide acceptance, possibly because of the relatively complicated mechanism of the image-wise transfer of an image-forming substance from a donor layer to a receiving layer as a result of applied heat patterns. Other problems may be involved in the coherence of the image-forming substance which may not consistently yield images of a resolution sufficiently fine to be acceptable to consumers. Still further problems may result from the difficulty of removing microscopical irregularities and air gaps when using two separate donor and receiver webs. It appears that none of the thermal imaging materials currently available satisfy the demand for high photographic quality or high resolution required by industry.

It is, therefore, desirable to provide a thermal imaging medium of superior performance for forming images of high resolution by a simplified mechanism of image-formation.

OBJECTS AND SUMMARY OF THE INVENTION

It is an object of the invention to provide an improved high resolution thermal imaging medium.

It is a further object of the invention to provide a novel high resolution thermal imaging medium which requires no transfer of the imaging-forming substance from a donor sheet to a receiving sheet.

Another object of the invention resides in the provision of a thermal imaging medium yielding images of improved density.

A further object of the invention resides in the provision of a thermal imaging medium of improved sensitivity.

It is also an object of the invention to provide a thermal imaging medium exposable by a source of heat controlled in a binary fashion.

Still another object resides in the provision of a thermal imaging medium of improved abrasion resistance.

In accordance with the invention there is provided a thermal imaging medium for forming images in response to intense image-forming radiation, comprising a support web formed of a material transparent to said radiation and comprising an image forming surface at least a surface zone of which is liquefiable and flowable at a predetermined elevated temperature range, a layer of porous or particulate image forming substance uniformly coated on said image forming surface, said image forming substance being absorptive of said radiation to convert it to thermal energy capable of liquefying said surface zone of said image forming surface, the surface zone, when liquefied, exhibiting capillary flow into adjacent portions of said image forming substance, thereby substantially locking said layer of image forming substance to said support web when said surface zone cools, said surface zone comprising a polymeric material of a type liquefying and solidifying in a short time.

In a preferred embodiment of the invention the material of the image forming surface is such that it has a narrow temperature range between liquefying and solidifying.

DESCRIPTION OF THE PREFERRED EMBODIMENTS

Figure 1:
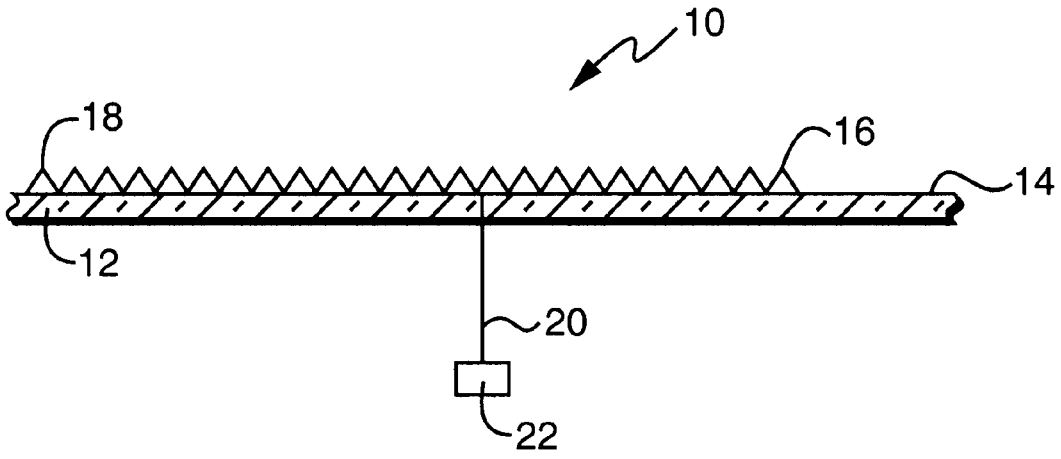
FIG. 1 is a cross-sectional view of a thermal imaging medium in accordance with the invention in its simplest form with a schematic illustration of its image forming mechanism.

As used in this specification, the term thermal imaging is intended to connote producing an image of a subject by exposing a recording medium or material to an image-wise distribution of thermal energy. A method particularly preferred for providing the image-wise distribution involves the use of a laser capable of providing a beam sufficiently fine to yield an image of as fine a resolution as one thousand (1000) dots per cm.

As will hereinafter be explained in detail, two steps are required to form an image in the thermal imaging medium in accordance with the present invention: one is proper heat exposure, the other is processing of the latent image by a process of removing from the medium those parts of an image forming substance which have not been exposed. The quality of the image thus obtained is a function of a reliably predictable interaction between these two variables.

For practical purposes and in accordance with a preferred method of exposing the medium in accordance with the invention, the source of heat utilized is a laser. Thus, in the context of the present specification the source of heat utilized for forming a latent image in the material will be assumed to be a laser, but it should be understood that the invention is not itself restricted to media for laser imaging.

In the event, laser exposures cause very high temperatures to be generated in the medium, at the interface between an image forming surface and an image forming substance deposited on the image forming surface as a particulate or porous uniform layer, hereinafter referred to as colorant/binder layer. The temperature may be as high as 400° C., but it is achieved for a very brief period only, e.g. 0.1 microsecond. It is achieving such high temperatures which causes the particulate or porous layer to adhere to the image forming surface of the medium. Once the exposed particulate layer has adhered to the image forming surface, an image may be formed by removing from the image forming surface those portions of the colorant/binder layer which have not been exposed. In preferred embodiments of the invention this may yield complementary "negative" and "positive" images.

Models of the mechanism for connecting exposed portions of the colorant/binder layer to the image forming surface, and of the removal of unexposed portions, may be used, with empirical experimentation, as guides to optimizing the chemistry of the layers to supplement the exposure and processing steps. While no definite reasons have been found explaining the superior performance of the thermal imaging medium of the present invention, electron-microscopical measurements seem to support the conclusions set forth below.

It is believed that the connection of the colorant/binder layer to the image forming surface may qualitatively be modelled on the Washburn equation for the rate of penetration of a liquid into a capillary. On the one hand, the pores of the particulate colorant/binder layer may be considered to constitute a plurality of capillaries; on the other hand, the image forming surface, when heated by the laser, may be assumed to act like a liquid, for polymeric materials of the kind here under consideration, when heated to about 400° C. are about as viscous as water at room temperature.

The Washburn equation is:

$$V=aG_{1\ v}\cos\theta/(4vL) \quad (1)$$

where "V" is the velocity of the liquid entering an isothermal capillary of radius "a"; "$G_1$" and "v" are, respectively, the surface tension and viscosity of the liquid; "θ" is the contact angle of the liquid with the particulate material; and "L" is the distance the liquid meniscus has travelled along the capillary. The Washburn equation was derived for isothermal systems. However, the medium of the present invention, when treated by a laser, is an anisothermal system. Thus, additional factors need be taken into consideration to arrive at a quantitative model of its behavior. Still, the Washburn equation is believed to be useful for qualitatively explaining the behavior of the imaging system in accordance with the invention.

The colorant/binder layer does not adhere to the image forming surface before laser heating because the viscosity of the unheated image forming surface is in excess of $10^{13}$ Pa.s ($10^{14}$ poise). During laser heating the viscosity drops to about 0.001 Pa.s (0.01 poise). Hence, the velocity of the capillary meniscus moving into the particulate layer is sixteen orders of magnitude higher during laser heating than at room temperature.

For practical purposes, the surface tension of most liquids may be assumed to decrease linearly with increasing temperature. When the medium in accordance with the invention is subjected, at least at the interface between the colorant/binder layer and the image forming surface, to a temperature of about 400° C. the resultant surface tension of the liquefied image forming surface is probably about zero.

As the contact angle normally decreases with increases in temperature it may be assumed that the rise in temperature in the material significantly reduced the contact angle of the liquefied image forming surface with the particulate layer.

Capillary attraction occurs when the tension of adhesion, $G_{1\ \nu}$ Cos θ, exceeds zero. This is important. For the adhesion tension determines whether the image forming surface possesses capillary attraction in respect of the particulate or porous colorant/binder layer, once the viscosity of the image forming surface has been lowered under the impact of laser heating. While conflicting effects occur with an increase in temperature in that $G_{1\ \nu}$ approaches zero and cos θ approaches one, it is nevertheless possible to generalize that (a) the adhesion tension cannot exceed $G_{1\ \nu}$ and (b) if the adhesion tension is less than zero capillary repulsion results. If the adhesion tension of the medium of the invention is between 0 and 0.05 N/m (0 and 50 dynes/cm), and the viscosity of its image forming surface varies between less than 0.001 Pa.s (0.01 poise) and $10^{13}$ Pa.s ($10^{14}$ poise), one may deduce from the Washburn equation that the enormous decrease in viscosity has rather greater an impact on the capillary penetration of the liquefied image forming surface into the particulate layer than the adhesion tension.

Once a latent image has been formed in the image forming surface by its capillary penetration into "exposed" portions of the layer of the image forming substance, further processing is required to render the image viewable. This processing requires removal of those portions of the particulate or porous colorant/binder layer from the image forming surface which have not been treated or exposed by the laser. While the manner of removal of the unexposed portions is immaterial to the concept of the invention, for reasons to be described removal by a peeling process is currently preferred.

The peeling process may qualitatively be modelled on a "plunger" analogy. The balance between the force acting to peel an unexposed spot in the colorant/binder layer off the image forming surface, and the sum of the cohesive and base adhesive forces of the colorant/binder layer determines whether or not removal of a spot will take place. That is to say, an isolated unexposed spot in an exposed area is not removed from the image forming surface if $$Fp<Fb+(2L/r)Fc;$$

where Fp, Fb and Fc are, respectively, the force acting to peel the layer off the image forming surface, the force of adhesion of the layer to the image forming surface and the cohesive force of the layer. L is the thickness of the colorant/binder layer and r is the radius of the spot.

For forming images of high resolution or photographic quality, the radius (r) of the spot must be very small. This produces a cohesive force {(2L/r)Fc} which is very large, and may prevent removing small unexposed spots from the image forming surface. A colorant/binder layer with lower cohesion (Fc) and a small thickness (L) will reduce the cohesive force and allow removing small unexposed spots. However, low cohesion will result in splitting of the particulate layer, rather than in a clean transfer, during peeling. This prevents producing clean "positive" and "negative" images and makes the density of the obtainable image unpredictable. Therefore, to provide images of high resolution, without splitting of the particulate layer, the cohesion of this layer must exceed either the adhesive or the peeling force (Fc>Fb or Fp). However, the cohesion and/or thickness of this layer must not exceed specific values determined by the desired resolution of the final image.

The peeling force is dependent on the peeling temperature and the rate of peeling. While there may exist an ideal temperature related to an ideal peeling rate, the medium should offer parameters which allow producing satisfactory images under less than ideal circumstances.

Exposing the medium by means of a laser is believed to increase Fb and/or decrease Fs. For instance, if the colorant/binder layer of the medium is covered by a heat activated release layer the heat generated by the laser exposure will decrease Fp, or if the image forming surface is heat activated the heat from the laser will increase Fb.

Materials providing image forming surfaces and colorant/binder layers may be selected on the basis of the criteria set forth above. In this connection, the great importance of viscosity requires selecting materials that display a catastrophic drop in viscosity with increasing temperature at high frequency or short periods.

The frequency dependence of the viscosity at a given temperature is of great importance since the heat of the laser is only applied for about $10^{-7}$ s ($10^{7}$ Hz).

A thermal imaging material, referred to as the medium, useful for practicing the invention and identified by reference numeral 10 in FIG. 1 basically comprises a first web 12 of polymeric material pervious to image forming radiation and having a substantially continuous smooth image forming surface 14 upon which there is uniformly deposited a uniformly thin particulate or porous colorant/binder layer 16 for forming images in the surface 14 of the web 12.

The web 12 may be present in the form of an integral unit having a thickness of from about 1 to about 1000 μm, or it may be laminated, either permanently or temporarily, to a subcoat, such as paper or another polymeric material, as a uniform layer of a thickness sufficient for purposes to be described. Although not shown, persons skilled in the art would appreciate that owing to the nature of the material such subcoat would be positioned on the web 12 at its surface opposite the image forming surface 14. The web 12 is preferably made of a material which, when subjected to intense heat within a defined range of elevated temperatures at about 400° C., experiences a catastrophic change in viscosity, as from about $10^{13}$ Pa.s ($10^{14}$ poise) at room temperature to about $10^{-3}$ Pa.s ($10^{-2}$ poise) at the elevated temperature. Furthermore, lest images formed in it be distorted, the web 12 when subjected to radiation for liquefying its image forming surface 14 followed by a no less rapid cooling for solidifying the surface, should be dimensionally stable in the sense that it neither expand nor contract in any dimension as a result of such vast changes in temperature.

Materials suitable as webs 12 include polystyrene, polyethylene terephthalate, polyethylene, polypropylene, copolymers of styrene and acrylonitrile, polyvinyl chloride, polycarbonate and vinylidene chloride. At present, polyethylene terephthalate as traded by E. I. du Pont de Nemours & Co. under its tradename Mylar or by Eastman Kodak Company under its tradename Kodel is preferred.

The layer 16 comprises an image forming substance deposited on the image forming surface 14 as a porous or particulate coating. The layer 16 may preferably be formed from a colorant dispersed in a binder, the colorant being a pigment of any desired color preferably substantially inert to the elevated temperatures required for image formation. Carbon black has been found to be of particular advantage. It may preferably have particles 18 of an average diameter of about 0.1 to 10 micrometers. Although the description will be substantially restricted to describing the use of carbon black, other optically dense substances, such as graphite, phthalocyanine pigments, and other colored pigments, may be used to equal advantage. It may even be possible to utilize substances which change their optical density when subjected to temperatures as herein described.

The binder provides a matrix to form the pigment particles into a cohesive mass and serves initially physically to adhere the pigment/binder layer 16 in its dry state to the image forming surface 14 of the web 12. The ratio of pigment to binder may be in the range of from about 40:1 to about 1:2 on a weight basis. In a preferred embodiment the ratio is about 5:1. Advantageous ly, for ease of uniformly coating the image forming surface 14 with the layer 16, the carbon particles 18 may initially be suspended in a preferably inert liquid for spreading, in their suspended state, over the image forming surface 14. Thereafter, the layer 16 may be dried to adhere to the surface 14. It will be appreciated that to improve its spreading characteristics the carbon may be treated with surfactants such as, for instance, ammonium perfluoroalkyl sulfonate. Other substances, such as emulsifiers may be used or added to improve the uniformity of distribution of the carbon in its suspended and, thereafter, in its spread dry states. The layer may range in thickness from about 0.1 to about 10 micrometers. Thinner layers are preferred because they tend to provide images of higher resolution.

Gelatin, polyvinyl alcohol, hydroxyethylcellulose, gum arabic, methylcellulose, polyvinylpyrrolidone, polyethyloxazoline and polystyrene latex are examples of binder materials suitable for use in the present invention.

If desired, submicroscopic particles, such as chitin and/or polyamide may be added to the colorant/binder layer 16 to provide abrasion resistance to the finished image. The particles may be present in amounts of from about 1:2 to about 1:20, particles to layer solids, weight/weight basis. Polytetrafluoroethylene particles are particularly useful.

To be suited for thermal imaging, the medium must be capable of absorbing energy at the wavelength of the exposing source at or near the interface of the web 12, i.e. the image forming surface 14, and the layer 16. The energy absorption characteristic is either inherent in the layer 16 or it may be provided as a separate heat absorption layer.

To form an image in the image forming surface 14 of the web 12 a laser beam, schematically indicated by arrow 20, of a fineness corresponding to the desired high resolution of the image is directed to the interface between the colorant/binder layer 16 and the image forming surface 14, through the web 12. The beam 20 emanates from a laser schematically shown at 22 and is scanned across the image forming surface 14 in a pattern conforming to the image to be formed. The beam 20 is absorbed at the interface and is converted to heat measuring about 400° C., although depending on the characteristics of the image forming surface 14, lower temperatures may also be effective for the purpose of forming an image. As will be appreciated by those skilled in the art, the image-wise scanning may be accomplished by linearly scanning the image forming surface 14 and modulating the laser 22, preferably in a binary fashion, to form the image by way of very fine dots in a manner not unlike half-tone printing.

While other lasers may be used for exposing the medium according to the invention, the laser 22 is preferably either a semiconductor diode laser or a YAG-laser and may have a power output sufficient to stay within upper and lower exposure threshold values of the imaging medium 10. The laser 22 may have a power output in the range of about 40 to about 1000 mW. Exposure threshold value, as used herein, connotes, on the one hand, the minimum power required to effect an exposure and, on the other, maximum power output tolerable to the imaging medium 10 before a "burn out" occurs. Furthermore, the laser 22 is equipped with focussing apparatus (not shown) for precisely focussing the laser beam.

Lasers are particularly suitable for exposing the medium of the invention because the latter is intended as what may conveniently be termed a threshold type film. That is to say, it possesses high contrast and, if exposed beyond a certain threshold value, it will yield maximum density, whereas no density at all is obtained below this threshold.

The intensity of a focussed Gaussian laser beam gradually decreases from a maximum in the center of the beam. Thus, if the medium were not capable of threshold or, as it were, binary behavior, dots written by a Gaussian laser beam would display a gradual decrease in density from their center towards their margin. The rate of decrease in density is sometimes referred to as the "gamma" of the medium. A low gamma medium would display spots of soft or gradual edges. By contrast, high gamma media would write sharp spots with crisp edges. The medium in accordance with the present invention is such a high gamma medium in that edges are attainable which are sharper than those of the exposing laser beam. In other words, the written dots may be modulated to be either completely dark or completely clear, so that the density of an image formed in the image forming surface of media in accordance with the present invention may be varied by a half-tone technique in which increasing area and/or number of dark dots increase the density of that area. Images may, therefore, be created with the medium of the present invention which in quality resemble photographs.

As inferred above, focussed laser beams cannot produce a uniformly intense spot, so that in the manner of the very common Gaussian beam spot, some areas of the film, i.e. the medium, may be considered to be well under and well over its exposure threshold. In the Gaussian beam spot the intensity distribution is given by an exponential decay:

$$\text{intensity}=I=I_0 \exp(-2(r/r_0)^2) \tag{2}$$

where $r_0$ is the radius of the beam where the intensity has dropped to $1/e^2$ of the peak value and $I_0$ is the beam intensity at r=0. If the intensity of the film exposure threshold is $I_f$, the area of a written spot, provided there is no motion between the medium and the laser beam, is:

$$\pi r^2=0.5\pi r_0^2 \ln(I_0/I_f). \tag{3}$$

Accordingly, the optimum use of laser energy for a stationary Gaussian laser occurs when $I_0/I_f=e=2.72$ as obtained by maximizing the efficiency of laser power usage:

$$(I_f/I_0)\ln(I_0/I_f). \quad (4)$$

If the intensity of the exposure threshold of the medium is less than or equal to $I_0$, i.e. $I_0/I_f<1$, the area of the spot is zero. Thus, there is no written spot. However, if $I_0/I_f=e$ the area of the spot equals $0.5\pi r_0^2$, the optimal value. Therefore, a spot can only be written on the medium if the center of the focussed Gaussian laser beam is above the exposure threshold of the medium. Since for focussed laser beams it is generally true that points inside a written spot receive an exposure density in excess of the exposure threshold density, it is important that the medium does not decompose, burn out or otherwise perform poorly when exposed to intensities higher than the minimum threshold value.

When the laser power efficiency is less than optimal, images of superior quality may nevertheless be obtained provided the center of the written spot withstands an exposure intensity above the film exposure threshold intensity.

For purposes of forming an image in the surface 14 of the medium 10 depicted in FIG. 1, it is necessary that the web 12 be substantially non-absorptive of the wavelength of the laser, so that its beam may penetrate to the interface. In the present embodiment, the energy of the laser 22 is directed and penetrates through the web 12. As will be appreciated by those skilled in the art, birefringence of the support web 12 and of the image forming surface 14 must be taken into consideration when focussing lasers to small spots. If the spot is too small, e.g. <5 $\mu$m, support of the materials of these elements may cause distortion of the spot shape and loss of resolution and sensitivity. In order to develop the heat required at the interface momentarily to liquefy the image forming surface 14 of the web 12, either the surface zone 14 or the particulate layer 16 must be heat absorptive or include a heat absorbing material. For instance, infrared absorbing layers have been found to be useful in this respect. However, carbon black being itself an excellent heat absorbing material, it may not be necessary or economical to provide a special layer.

Figure 11:
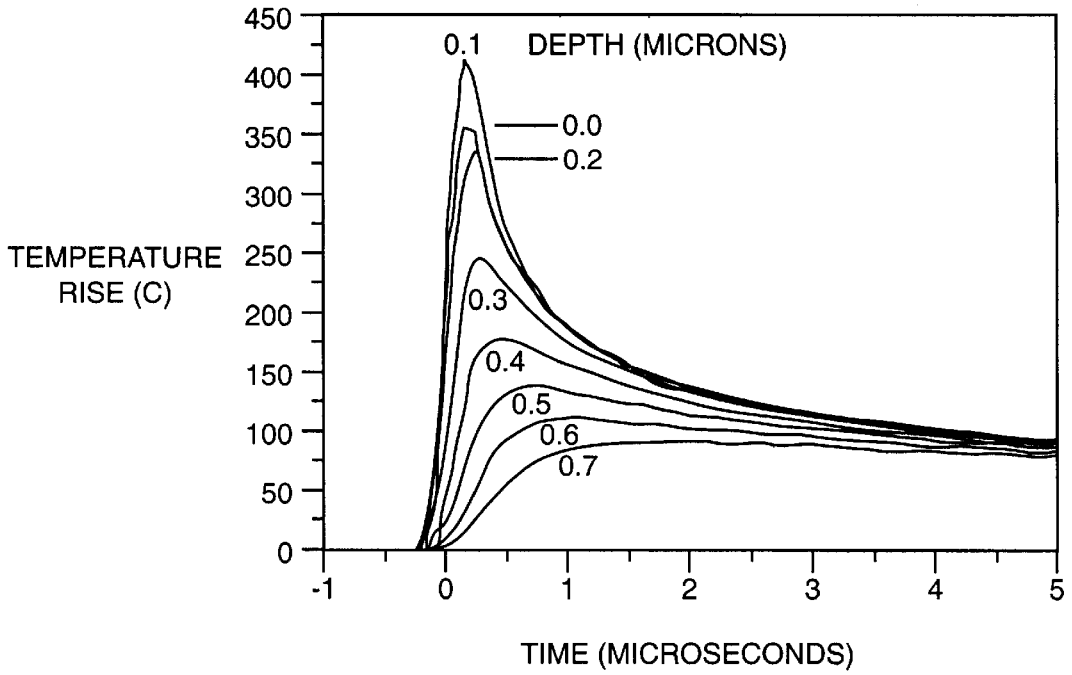
FIG. 11 is a diagram illustrating the relationship between exposure time and temperature for various depths into the image forming surface of the element according to the invention.
Figure 12:
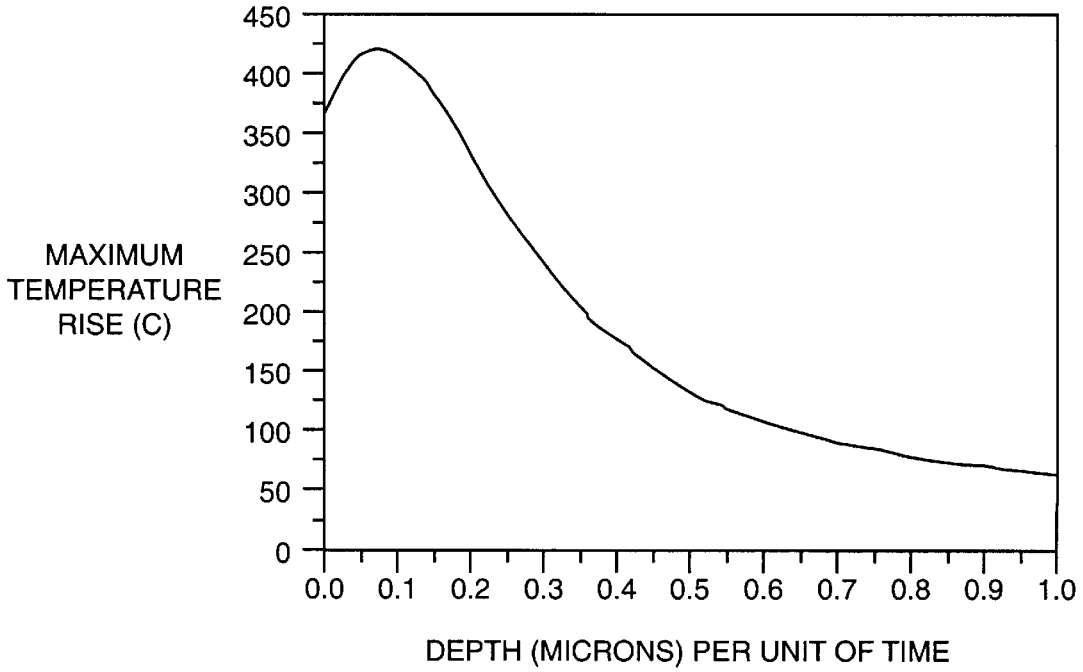
FIG. 12 is a diagram illustrating the effect of temperature on the image forming surface of the thermal imaging medium of the present invention.

The intense (about 400° C.) and locally applied heat developed at the interface between the image forming surface 14 and the particulate layer 16 causes the surface 14, where it is subjected to the heat, to liquefy, i.e. experience a catastrophic drop in viscosity from about $10^{13}$ Pa.s ($10^{14}$ poise) to about $10^{-3}$ Pa.s ($10^{-2}$ poise). As may be seen in FIG. 11, the heat is applied for an extremely short period, preferably in the order of <0.5 microseconds, and causes liquefactions of the material to a depth of about 0.1 micrometer (see FIG. 12).

At this low viscosity the liquefied material exhibits capillary action with respect to the carbon black particles 18 of the layer 16 sufficiently to penetrate voids between the particles 18 without totally absorbing them. It is believed that the limited penetration of the liquefied surface material into the voids between the carbon black particles 18 is responsible for the fine resolution of images attainable with media of the present invention.

Lest the image to be produced lose its desired high resolution because of excessive flow of liquefied surface material, liquefaction and subsequent solidification of the image forming surface 14 must occur within a very small interval, in terms of both time and temperature. For instance, the exposure time span may be <1 msec and the temperature span may be between about 100° C. and about 1000° C.

Figure 2:
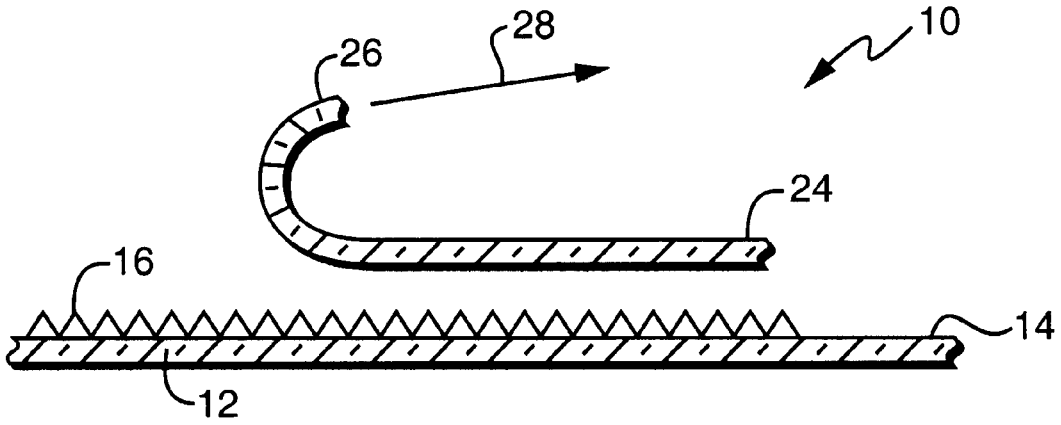
FIG. 2 is a cross-sectional view of the thermal imaging medium of FIG. 1 schematically illustrating the processing of the image to its viewable state.
Figure 6:
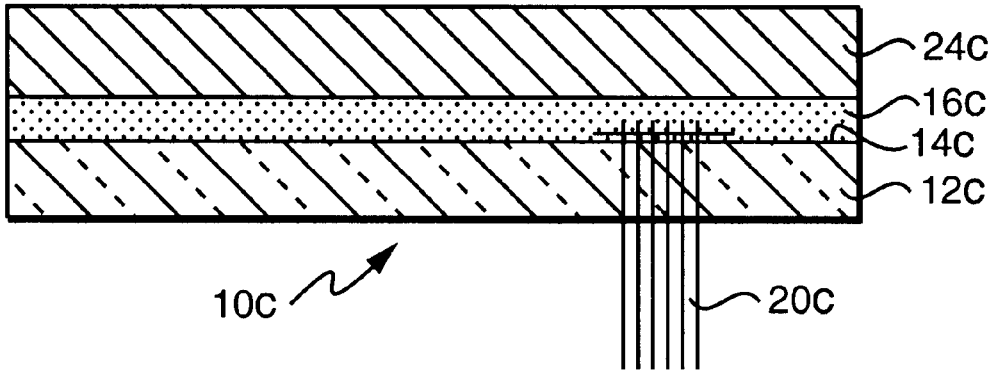
FIG. 6 is a cross-sectional view of thermal imaging medium in accordance with the invention and depicting the action of a laser.
Figure 7:
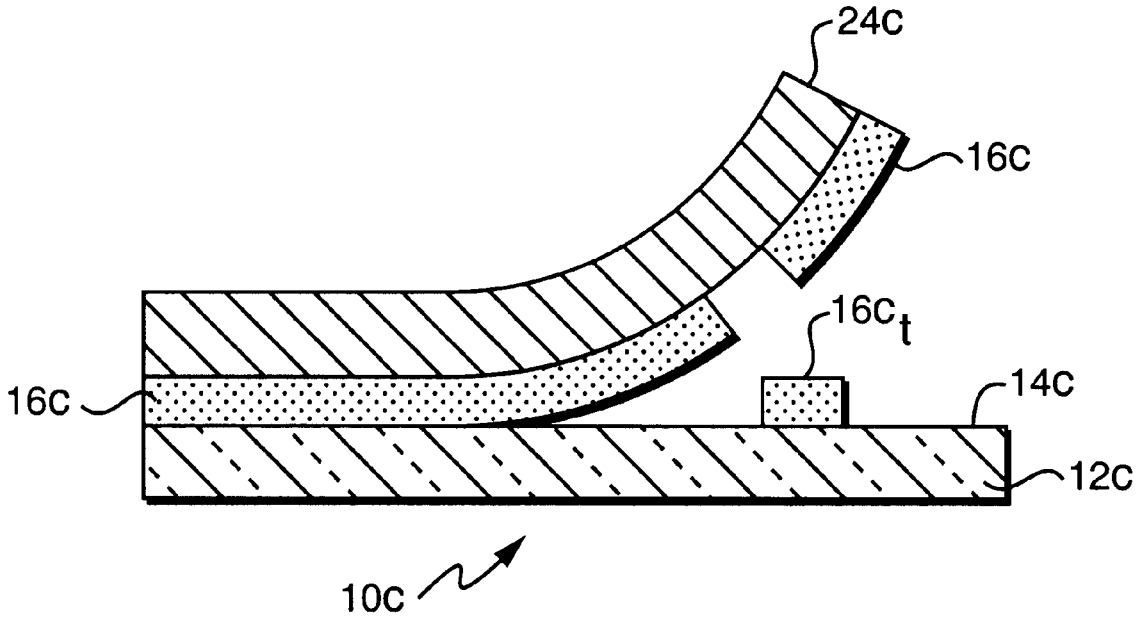
FIG. 7 is a cross-sectional view of the medium of FIG. 6 after exposure, with its image forming and processing layers partially separated.

After exposure of the medium in the manner described, a sheet 24 having a surface 26 covered with a pressure sensitive adhesive may be superposed on the particulate layer 16, and may then be removed or peeled off in the manner indicated by an arrow 28 (see FIG. 2). As the sheet 24 is removed, it carries with it those portions (see $\mathbf{16}_{cu}$ in FIG. 7) of the particulate layer 16 which were not subjected to the heat of the laser 22. As illustrated in FIGS. 6 and 7, the portions designated $\mathbf{16}_{ct}$ treated by the laser beam 22 remain firmly attached to the surface $\mathbf{14}_c$ in form of what for the sake of convenience may be called a "negative" image, the parts $\mathbf{16}_{cu}$ removed with the sheet $\mathbf{24}_c$ forming a complementary or "positive" image. To yield sharp images, it is necessary that the particulate layer 16 possess an inherent cohesion greater than its adhesion to the stripping sheet 24 and the web 12.

The particulate layer 16 spread upon the surface 14 of the web 12 preferably adheres thereto, at least initially, in a manner precluding its accidental dislocation. While, as indicated supra, the particulate layer 16 may be provided with a matrix, it has been found that carbon black applied to the surface 14 in powder form, without any binding agent, will connect to the surface 14 in the manner of this invention after treatment with a heat source. The untreated carbon black may then be removed by rubbing or washing or the like instead of, as in the above embodiment, by an adhesive strip sheet 24.

Figure 3:
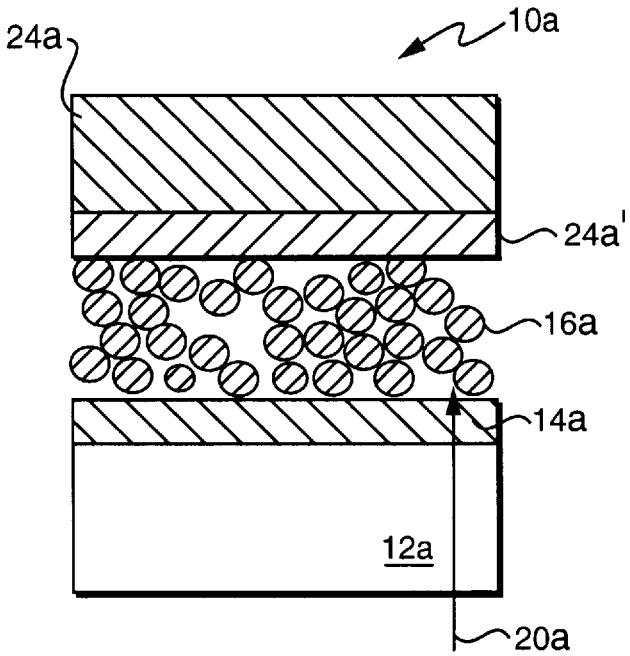
FIG. 3 is a cross-sectional view of a preferred embodiment of the thermal imaging medium of the present invention before an exposure.

As shown by the preferred embodiment of FIG. 3, the medium 10*a* may be a laminate structure comprising a web 12*a* having an image forming surface 14*a*, a porous or particulate image forming layer 16*a* positioned on the surface 14*a*, a stripping or peeling sheet 24*a*, and a release layer 24*a*' in contact with the particulate layer 16*a* and deposited on the stripping sheet 24*a*.

Figure 3A:
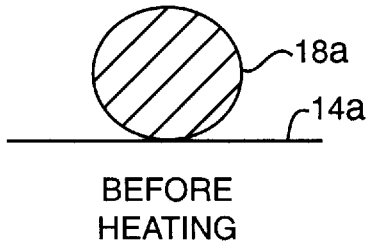
FIG. 3*a* is a schematic presentation of a colorant particle positioned on an image forming surface before exposure.
Figure 4:
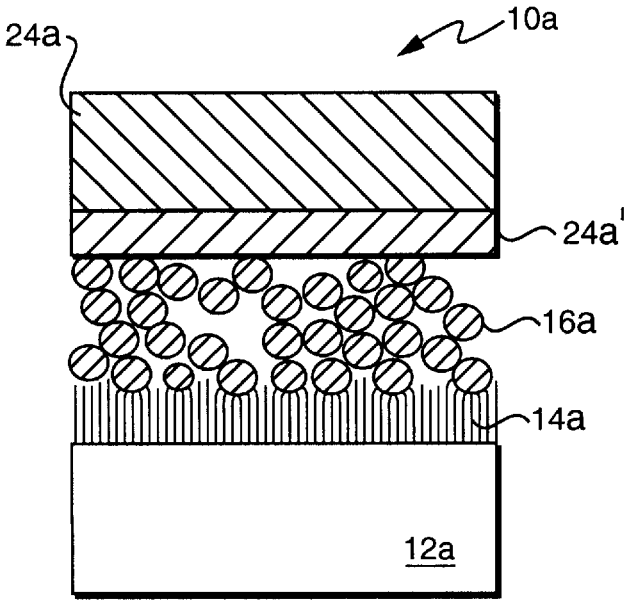
FIG. 4 is a cross-sectional view of the thermal imaging medium of FIG. 3 after exposure.
Figure 4A:
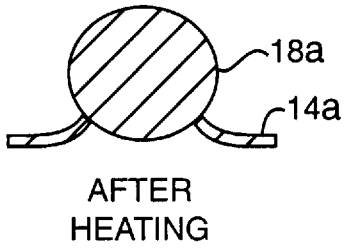
FIG. 4*a* is a view similar to FIG. 3*a* showing the particle in relation to the image forming surface after exposure.

In FIG. 3*a*, the particulate matter 18*a* forming the colorant/binder layer is positioned on the image forming surface 14*a* and does not penetrate into it. The thermal imaging medium 10*a* may be exposed by a laser beam 20*a* (see FIG. 4) in the manner previously described. Thereafter, the stripping sheet 24*a* may be removed carrying with it those portions 16*a* of the particulate colorant layer 16*a* which have not been treated by the laser beam 20*a*. The treated portions 16*a* will remain, firmly connected to the web 12.

Figure 5:
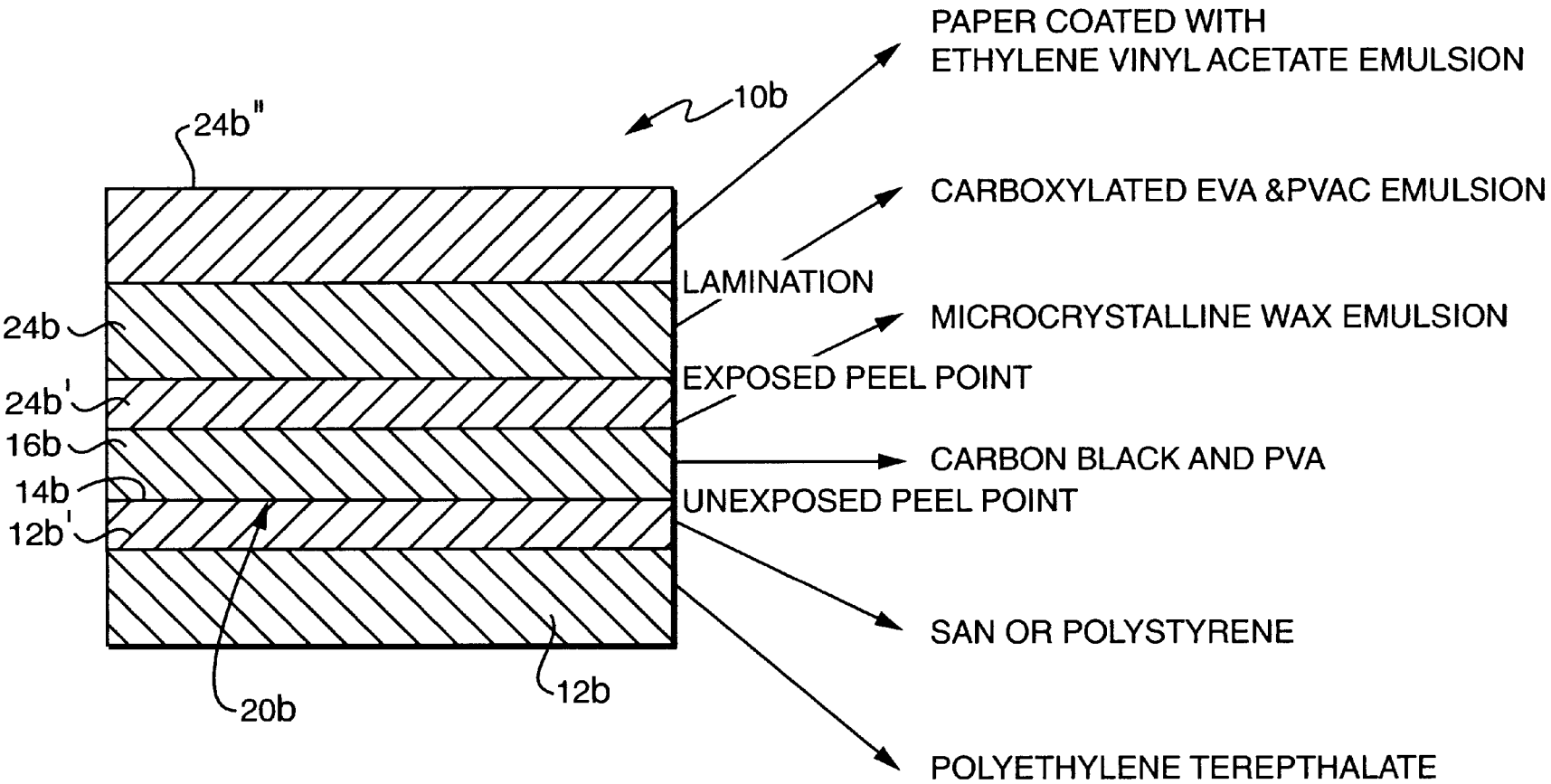
FIG. 5 is a cross-sectional view of a alternate embodiment of a thermal imaging medium in accordance with the invention.

An embodiment of a particularly preferred thermal imaging medium 10*b* is depicted in FIG. 5. The medium 10*b* comprises a web 12*b* preferably made of polyethylene terephthalate (Mylar) with a subcoat 12*b*' made of polystyrene or styreneacrylonitrile (SAN). Placed on the subcoat 12*b*' and in contact with an image forming surface 14*b* thereof is a particulate or porous colorant/binder layer 16*b* comprising carbon black and polyvinylalcohol. A release coat 24*b*' made of a microcrystalline wax emulsion (Nichelman 160) is placed over the colorant/binder layer 16*b*. The release coat 24*b*' is in turn covered by a stripping sheet 24*b* made of carboxylated ethylenevinylacetate and polyvinylacetate (Airflex 416 and Daratak 61L). Finally, a web 24*b*" of paper coated with an emulsion of ethylenevinylacetate (Airflex 400) is coated over the stripping sheet 24*b*. The medium 10*b* is preferably exposed by a laser beam 20*b* directed through the web 12*b* to generate heat at the interface between the colorant binder layer 16*b* and the surface 14*b* of the web 12*b*. A heat absorption layer, such as an IR-absorber, (not shown) may additionally be provided to direct the effect of the laser beam to a predetermined location in the laminate structure of the medium 10*b*.

The relative adhesive strengths between the several layers of the laminate medium 10*b* are such that before exposure separation would occur between the subcoat 12*b*' and the colorant/binder layer 16*b*, whereas after exposure the separation would occur between or within the release coat 24*b*' and the stripping sheet 24*b*.

This embodiment offers several distinct advantages: a) The microcrystalline wax release coat 24*b*' provides an effective protection against abrasion of the image created in the surface 14*b*; b) the wax release coat 24*b*' appears to improve the sensitivity of the medium because of its hydrophobic nature which may avoid the necessity of the laser energy "boiling off" water from the coating. Furthermore, the use of a hot melt adhesive in the stripping sheet 24*b* allows a laminate structure which may provide for an improved automatic peeling by a device integrated into the laser printer.

Another embodiment of the medium 10*c* is shown in FIG. 6. This embodiment comprises a web 12*c* covered by a colorant/binder layer 16*c*, which in turn is covered by a stripping sheet 24*c*. Exposure of the medium 10*c* is accomplished by a laser beam 20*c* directed through the web 12*c* to generate heat in the manner described above at the interface between the colorant/binder layer 16*c* and the web surface 14*c*.

FIG. 7 is a cross-sectional view of the embodiment of FIG. 6 and shows the separation of the stripping sheet 24*c* including unexposed portions $\mathbf{16}c_u$ of the colorant/binder layer 16*c* from the web 12*c* and the exposed portions $\mathbf{16}c_t$.

Figure 8:
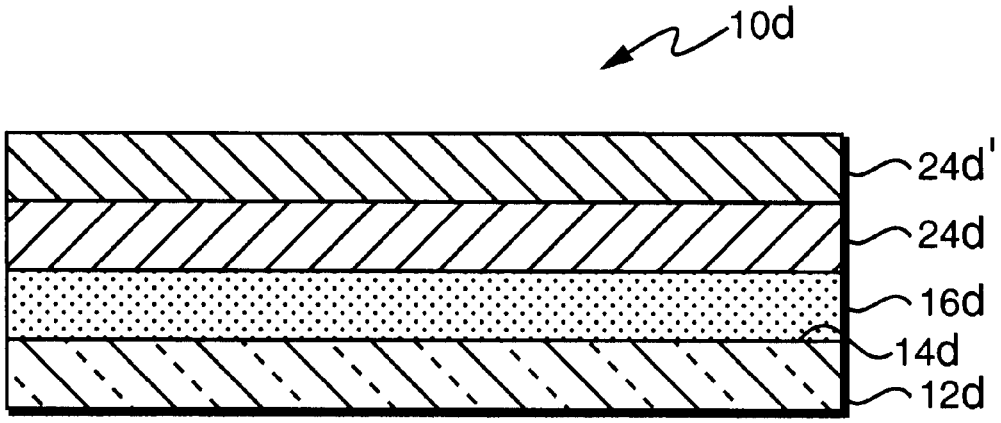
FIGS. 8–10 are cross-sectional views of further embodiments of thermal imaging media according to the invention.

FIG. 8 depicts an embodiment of the invention in which the stripping sheet 24*d* on its surface opposite the particulate or porous colorant/binder layer 16*d* is provided with a support layer 24*d*' made, for instance, of paper. The paper support 24*d*' may be useful for providing a reflection print complementing the image formed in the imaging surface 14*d* of the web 12*d*, i.e. it may be a positive image of a negative image formed in the imaging surface 14*d*, or vice versa.

Figure 9:
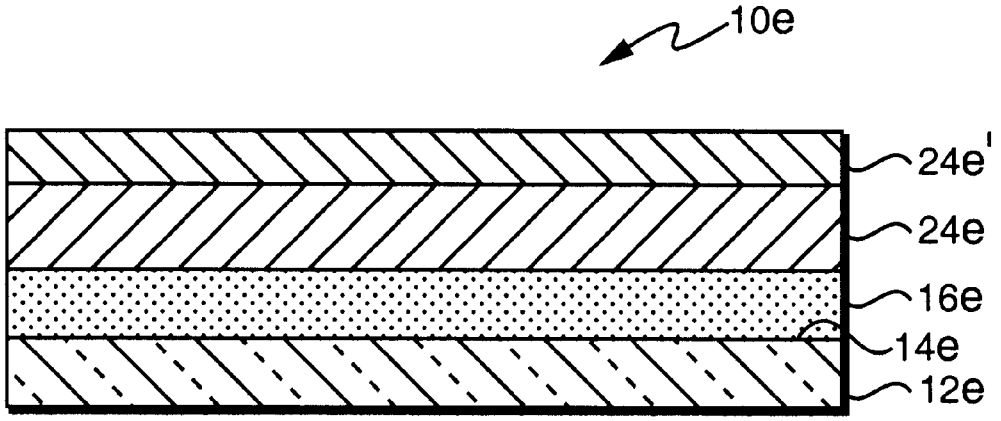

FIG. 9 is a rendition of a medium 10*e* similar to that of FIG. 6 except that it is provided with an adhesive layer 24*e*' laminated to the stripping sheet 24*e*. The adhesive layer 24*e*' is preferably made from a pressure sensitive adhesive and may be useful for automatic removal of the stripping sheet 24*e* by means of a rotating drum (not shown) brought into contact with the adhesive layer 24*e*.

Figure 10:
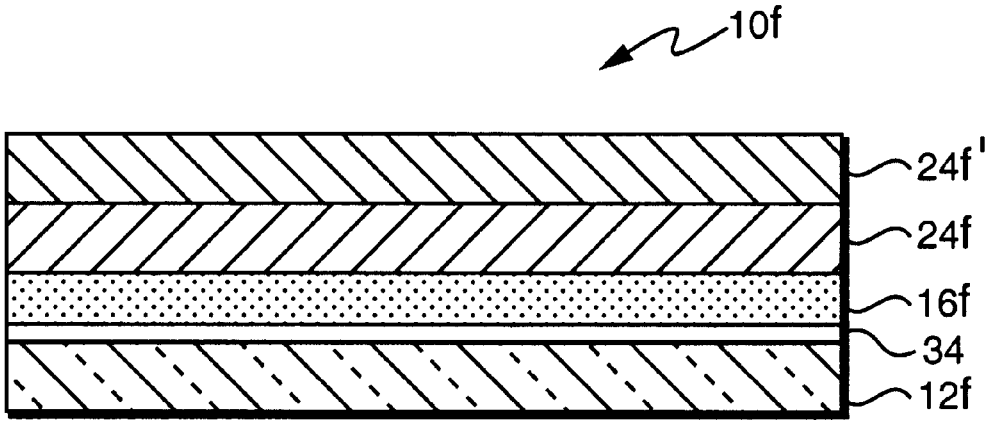

FIG. 10 depicts an embodiment having an infrared absorbing layer 34 interposed between the web 12*f* and the particulate colorant/binder layer 16*f* for purposes described above.

The following examples illustrate the thermal imaging medium of the present invention.

EXAMPLE I

A carbon black solution was prepared from

- 4.25 g carbon black solution (43% solids) (sold under the tradename Flexiverse Black CFD-4343 by Sun Chemical Co.);
- 21.84 g water;
- 3.66 g polyethyloxazoline (10% aqueous solution) (sold under the tradename PEOX by Dow Chemical Co.);
- 0.24 g fluorochemical surfactant (25% solids) (sold under the tradename FLUORAD FC-120 by 3M Co.)

and coated onto a polyethylene terephthalate (Mylar) web of 0.1 mm thickness with a No. 10 wire wound rod and air dried to give a dry coverage of about 0.7 g/m$^2$. The structure was exposed through the web by a laser beam with 0.1 J/cm$^2$ for 1 microsecond. After exposure (the delay until this next step could be for any length of time) the layer was overcoated with a solution of

- 60.0 g gelatin (15% solids):
- 29.3 g water;
- 0.72 g FLUORAD surfactant to give a dry layer of about 7 g/m$^2$. Pressure sensitive adhesive tape was applied to the gelatin layer. The adhesive tape was peeled from the element leaving a negative carbon black image firmly connected to the surface of the web in areas of laser exposure.

EXAMPLE II

A carbon black solution containing no polymeric binder or FLUORAD surfactant was prepared from

- 4.07 g carbon black solution (45% solids) (sold under the tradename Sunsperse Black LHD-6018 by Sun Chemical Co.)
- 23.93 g water and coated onto the Mylar web as in Example I, to give a dry coverage of about 0.7 g/m$^2$. The structure was exposed through the web and developed as in Example I. This example illustrated the the polymeric binder and surfactant present in Example I are not necessary to connect the exposed carbon black firmly to the surface of the web.

EXAMPLE III

The unexposed carbon black coated web from Example I was coated with a release layer from a solution consisting of:

- 2.00 g was emulsion (25% solids) (sold under the tradename Michemlube 160 by Michelman Chemicals, Inc.):
- 7.92 g water;
- 0.08 g FLUORAD surfactant with a No. 10 wire-wound rod to give a dry layer coverage of about 0.04 g/m$^2$. This was overcoated with a stripping layer from a solution consisting of

- 60.00 g carboxylated ethylenevinylacetate copolymer emulsion (52% solids) (sold under the tradename Airflex 416 by Air Products and Chemicals, Inc.); and
- 40.00 g polyvinylacetate emulsion (55% solids) (sold under the tradename Daratak 61L by W. R. Grace & Co.)

to give a dry layer coverage of about 20 g/m$^2$. The structure was exposed through the web by a laser beam with 0.1 J/cm$^2$ for 1 microsecond. The stripping layer was peeled from the element leaving a negative carbon black image firmly connected to the surface of the web in areas of laser exposure. The stripping layer contained a reverse of this image, i.e., it was transparent in areas of laser exposure.

Another structure was prepared as in Example III but with the wax emulsion replaced by a polyethylene aqueous was emulsion (sold under the tradename Jonwax 26 by S. C. Johnson and Son, Inc.) at the same concentration and coverage.

Another structure was prepared in the manner of Example III, except the polyvinylalcohol was substituted in equal amounts for polyethyloxazoline.

Another structure was prepared as in Example III but the Mylar surface was first coated with 2 g/m$^2$ of styrene acrylonitrile copolymer.

EXAMPLE IV

The unexposed carbon black coated web of Example III was laminated at about 75° C. to a second Mylar web of 0.1 mm thickness. The laminated structure was exposed through the carbon black coated web of Example III by a laser beam of 0.1 J/cm$^2$ for 1 microsecond. After exposure the laminate was peeled apart to produce one negative and one positive image. The negative image consisted of exposed carbon black firmly connected to the surface of the web of Example III. The positive image consisted of unexposed carbon black adhered to the surface of the stripping layer, the latter being adhered to the surface of the second Mylar web. The stripping layer was then peeled from the second Mylar web so the latter could be used again for another lamination and peeling.

EXAMPLE V

The second Mylar web of Example IV, prior to lamination, was coated with an adhesive solution consisting of ethylenevinylacetate copolymer emulsion (52% solids) (sold under the tradename Airflex 400 by Air Products and Chemicals, Inc.) to give a dry coverage of about 5 g/m$^2$. The unexposed carbon black coated web from Example III was laminated at about 70° C. to this second Mylar web with the adhesive coating of this example in face-to-face contact with the stripping layer of Example III. The laminate was exposed and processed as in Example IV.

After exposure, the laminate was peeled apart to produce one negative and one positive image. However, because of the adhesive layer in this example the stripping layer could not be peeled from the second Mylar web. This example was repeated with a paper second web instead of Mylar to produce a reflection image in this web instead of a transparency.

The second web of this example was heated after the peeling step to a temperature above the melting point of the wax release layer (about 90° C.). This improved the durability of the image by allowing the melted wax to flow into the porous carbon black layer.

Samples were prepared as in Example IV and this example but the lamination was performed after the laser exposure instead of before. There was no detectable difference in the image quality.

EXAMPLE VI

The stripping layer surface of the unexposed carbon black containing web from Example III was overcoated with a 40% aqueous solution of polyethyloxazoline (as in Example I) to give a dry coverage of about 10 g/m$^2$. This dried layer was then overcoated with a solution containing equal amounts of a 20% aqueous solution of polyethyloxazoline and a 27.5% aqueous solution of titanium dioxide to give a dry coverage of about 10 g/m$^2$. This structure was then exposed and peeled as in Example III to produce two images, the first being a negative carbon black image firmly connected to the surface of the Mylar web in areas of laser exposure. The second image was a positive reflection print image consisting of unexposed carbon black adhered to the surface of the stripping layer.

EXAMPLE VII

The unexposed carbon black coated web from Example III was coated with a release layer from a solution of 2.00 g wax emulsion (25% solids) (sold under the tradename Michemlube 160 by Michelman Chemicals, Inc.);

7.92 g water; and 0.08 g FLUORAD surfactant.

with a No. 10 wire-wound rod to give a dry layer coverage of about 0.4 g/m$^2$. This was then pressure laminated to transparent adhesive tape (sold under the tradename Book Tape #845 by 3M Co.). The laminated structure was exposed through the carbon black coated web by a laser beam with 0.1 J/cm$^2$ for one microsecond. After exposure the laminate was peeled apart to produce one negative and one positive image. The negative image consisted of exposed carbon black firmly connected to the surface of the web from Example III. The positive image consisted of unexposed carbon black adhered to the surface of the transparent adhesive tape.

The positive image was then rubbed with magenta pigment toner (sold under the tradename Spectra Magenta Toner by Sage Co.) such that it stuck to the adhesive tape in areas not covered by the unexposed carbon black. The toned positive image was then washed with soapy water to remove the unexposed carbon black and leave a negative magenta image on the transparent adhesive tape.

CONCLUSION

Certain modifications may be introduced into the medium of this invention without departing from the scope of protection sought.

For instance, it would be possible, for purposes of increasing the exposure sensitivity of the medium or of reducing the energy of the laser, to subject the medium to a pre-thermal treatment which would provide for an increased connection between the colorant/binder layer and the imaging surface without exposing the medium.

Furthermore, it may be possible to increase the exposure sensitivity of the medium by subjecting it to a blanket pre-heating process. Such a process may reduce the heat load on the laser otherwise required to reach the exposure threshold of the medium.

As will be apparent to persons skilled in the art, the medium of the present invention may, by appropriately poling the modulation of the laser beam, be useful in providing either positive or negative images in the imaging surfaces described above.

What is claimed is:

1. A thermal imaging medium for forming images in response to intense image-forming radiation, comprising:

a web material, said web material being a self-supporting sheet of thermoplastic material having a thickness from about 1 to about 1000 micrometers and provided with a subcoat of one of the group of polystyrene and a copolymer of styrene and acrylonitrile, said web material being transparent to said radiation and said subcoat providing an image-forming surface at least a surface zone of which comprises a polymeric material liquefiable and solidifiable in a short time; said surface zone being liquefiable and flowable at a predetermined elevated temperature range, upon subjection of said thermal imaging medium to brief and intense radiation, and being thereafter rapidly solidifiable upon cooling, said surface zone, when subjected to temperatures of about 400° C., exhibiting a catastrophic drop in viscosity of from about $10^{13}$ Pa.s to about 0.001 Pa.s;

a layer of porous or particulate image-forming substance uniformly coated and initially adhered to said web material sufficiently to prevent accidental dislocation; said layer having a cohesive strength greater than the adhesive strength between said layer and said web material;

said thermal imaging medium being capable of absorbing radiation rapidly at or near the interface of said image-forming surface and said layer of porous or particulate image-forming substance and being capable of converting absorbed energy into thermal energy of sufficient intensity to liquefy said surface zone of said image-forming surface at said predetermined elevated temperature range;

said surface zone, when liquefied, exhibiting capillary flow and penetrating into adjacent portions of said image-forming substance, said liquefied surface zone solidifying upon rapid cooling, thereby substantially locking said layer of image-forming substance to said web material.

2. A thermal imaging medium for forming images in response to intense image-forming radiation, comprising:

a web material transparent to said radiation and comprising an image-forming surface at least a surface zone of which comprises a polymeric material liquefiable and solidifiable in a short time; said surface zone being liquefiable and flowable at a predetermined elevated temperature range, upon subjection of said thermal imaging medium to brief and intense radiation, and being thereafter rapidly solidifiable upon cooling;

a layer of carbon black uniformly coated and initially adhered to said web material sufficiently to prevent accidental dislocation; said layer of carbon black comprising carbon black pigment particles having a particle size of about 0.1 to about 10 micrometers and including a surfactant comprising ammonium perfluoralkyl sulfonate; said layer having a thickness of from about 0.1 to about 10 micrometers and having a cohesive strength greater than the adhesive strength between said layer and said web material;

said thermal imaging medium being capable of absorbing radiation rapidly at or near the interface of said image-forming surface and said layer of carbon black and being capable of converting absorbed energy into thermal energy of sufficient intensity to liquefy said surface zone of said image-forming surface at said predetermined elevated temperature range;

said surface zone, when liquefied, exhibiting capillary flow and penetrating into adjacent portions of said carbon black pigment, said liquefied surface zone solidifying upon rapid cooling, thereby substantially locking said layer of carbon black to said web material.

3. A thermal imaging medium for forming images in response to intense image-forming radiation, comprising:

a web material transparent to said radiation and comprising an image-forming surface at least a surface zone of which comprises a polymeric material liquefiable and solidifiable in a short time; said surface zone being liquefiable and flowable at a predetermined elevated temperature range, upon subjection of said thermal imaging medium to brief and intense radiation, and being thereafter rapidly solidifiable upon cooling;

a layer of carbon black uniformly coated and initially adhered to said web material sufficiently to prevent accidental dislocation; said layer of carbon black having a thickness of from about 0.1 to about 10 micrometers and including polytetrafluoroethylene; said layer having a cohesive strength greater than the adhesive strength between said layer and said web material;

said thermal imaging medium being capable of absorbing radiation rapidly at or near the interface of said image-forming surface and said layer of carbon black and being capable of converting absorbed energy into thermal energy of sufficient intensity to liquefy said surface zone of said image-forming surface at said predetermined elevated temperature range;

said surface zone, when liquefied, exhibiting capillary flow and penetrating into adjacent portions of said carbon black pigment, said liquefied surface zone solidifying upon rapid cooling, thereby substantially locking said layer of carbon black to said web material.

4. The thermal imaging medium of claim 3, wherein said polytetrafluoroethylene is present in the pigment at a ratio of from about 1:2 to about 1:20 by weight.

5. A thermal imaging medium for forming images in response to intense image-forming radiation, comprising:

a web material transparent to said radiation and comprising an image-forming surface at least a surface zone of which comprises a polymeric material liquefiable and solidifiable in a short time; said surface zone being liquefiable and flowable at a predetermined elevated temperature range, upon subjection of said thermal imaging medium to brief and intense radiation, and being thereafter rapidly solidifiable upon cooling;

a layer of carbon black uniformly coated and initially adhered to said web material sufficiently to prevent accidental dislocation; said layer of carbon black having a thickness of from about 0.1 to about 10 micrometers and including chitin; said layer having a cohesive strength greater than the adhesive strength between said layer and said web material;

said thermal imaging medium being capable of absorbing radiation rapidly at or near the interface of said image-forming surface and said layer of carbon black and being capable of converting absorbed energy into thermal energy of sufficient intensity to liquefy said surface zone of said image-forming surface at said predetermined elevated temperature range;

said surface zone, when liquefied, exhibiting capillary flow and penetrating into adjacent portions of said carbon black pigment, said liquefied surface zone solidifying upon rapid cooling, thereby substantially locking said layer of carbon black to said web material.

6. A thermal imaging medium for forming images in response to intense image-forming radiation, comprising:

a web material transparent to said radiation and comprising an image-forming surface at least a surface zone of which comprises a polymeric material liquefiable and solidifiable in a short time; said surface zone being liquefiable and flowable at a predetermined elevated temperature range, upon subjection of said thermal imaging medium to brief and intense radiation, and being thereafter rapidly solidifiable upon cooling;

a layer of porous or particulate image-forming substance uniformly coated and initially adhered to said web material sufficiently to prevent accidental dislocation; said layer having a cohesive strength greater than the adhesive strength between said layer and said web material;

said thermal imaging medium being capable of absorbing radiation rapidly at or near the interface of said image-forming surface and said layer of porous or particulate image-forming substance and being capable of converting absorbed energy into thermal energy of sufficient intensity to liquefy said surface zone of said image-forming surface at said predetermined elevated temperature range;

said surface zone, when liquefied, exhibiting capillary flow and penetrating into adjacent portions of said image-forming substance, said liquefied surface zone solidifying upon rapid cooling, thereby substantially locking said layer of image-forming substance to said web material;

said thermal imaging medium further comprising a stripping sheet laminated onto the layer of image-forming substance on the side thereof opposite said web material, said stripping sheet comprises one of the group of carboxylated ethylenevinylacetate copolymer, polyvinylacetate, a copolymer of carboxylated ethylenevinylacetate and polyvinylacetate and paper coated with ethylenevinylacetate copolymer.

7. The thermal imaging medium of claim 6 wherein said stripping sheet has a surface coated with pressure sensitive adhesive.

8. The thermal imaging medium of claim 6, further comprising a coating for increasing the abrasion resistance of said layer of image-forming substance provided between said stripping sheet and said layer of image-forming substance.

9. The thermal imaging medium of claim 8, wherein said abrasion resistant coating comprises a microcrystalline wax.

10. The thermal imaging medium of claim 6, wherein said stripping sheet is provided with a protective sheet.

11. The thermal imaging medium of claim 10, wherein said protective sheet comprises paper.

12. A thermal imaging medium for forming images in response to intense image-forming radiation, comprising:

a web material comprising a polymeric sheet material transparent to said radiation and having an image-forming surface comprising a polymeric subcoat comprising polystyrene or styrene acrylonitrile copolymer;

a colorant/binder image-forming layer coated onto said web material and initially adhered to said web sufficiently to prevent accidental dislocation, said layer comprising pigment particles and a binder for forming the pigment particles into a cohesive layer, said cohesive layer having a cohesive strength greater than the adhesive strength between said layer and said web material;

said image-forming surface of said web having at least a surface zone heat activatable rapidly upon subjection of said thermal imaging medium to brief and intense radiation;

said thermal imaging medium being capable of absorbing radiation rapidly at or near the interface of said image-forming surface and said colorant/binder layer, at the wavelength of the exposing source; and being capable of converting absorbed energy into thermal energy of sufficient intensity to heat activate said surface zone rapidly; said heat-activated surface zone, upon rapid cooling, attaching said colorant/binder layer firmly to said web material;

said thermal imaging medium being adapted to image formation by imagewise exposure of portions of said thermal imaging medium to radiation of sufficient intensity to attach imagewise-exposed portions of said colorant/binder layer firmly to said web, and by removal of those portions of said colorant/binder layer which are not exposed to said radiation.

13. A thermal imaging medium for forming images in response to intense image-forming radiation, comprising:

a web material transparent to said radiation and having an image-forming surface;

a colorant/binder image-forming layer coated onto said web material and initially adhered to said web sufficiently to prevent accidental dislocation, said layer comprising pigment particles and a binder for forming the pigment particles into a cohesive layer, said cohesive layer having a cohesive strength greater than the adhesive strength between said layer and said web material;

said image-forming surface of said web having at least a surface zone heat activatable rapidly upon subjection of said thermal imaging medium to brief and intense radiation;

said thermal imaging medium being capable of absorbing radiation rapidly at or near the interface of said image-forming surface and said colorant/binder layer, at the wavelength of the exposing source; and being capable of converting absorbed energy into thermal energy of sufficient intensity to heat activate said surface zone rapidly; said heat-activated surface zone, upon rapid cooling, attaching said colorant/binder layer firmly to said web material;

said thermal imaging medium being adapted to image formation by imagewise exposure of portions of said thermal imaging medium to radiation of sufficient intensity to attach imagewise-exposed portions of said colorant/binder layer firmly to said web, and by removal of those portions of said colorant/binder layer which are not exposed to said radiation;

said thermal imaging medium further comprising a stripping sheet, said stripping sheet comprising a polymeric sheet material adhesively laminated to said colorant/binder layer, said stripping sheet being adapted, upon separation of said web material, and said stripping sheet after said imagewise exposure, to imagewise removal therewith of non-exposed portions of said colorant/binder layer;

said thermal imaging medium further comprising a release layer is provided between said stripping sheet and said colorant/binder layer, said release layer being adapted to facilitate separation between said web material and said stripping sheet, after said imagewise exposure, to provide a first image comprising imagewise-exposed portions of said colorant/binder layer firmly attached to said web, and a second image on said stripping sheet comprising non-exposed portions of said colorant/binder layer carried imagewise to said stripping sheet.

14. The thermal imaging medium of claim 13, wherein said release layer is adapted to separation within said release layer.

15. The thermal imaging medium of claim 13, wherein said release layer is adapted to separation from an adjacent layer.

16. A method of forming an image in a thermal imaging medium in response to intense image-forming radiation, comprising the steps of:

providing a web material having an image-forming surface at least a surface zone of which comprises a polymeric material liquefiable in a short time, said surface zone being liquefiable and flowable at a predetermined elevated temperature upon subjection of said thermal imaging medium to brief and intense radiation and being thereafter rapidly solidifiable upon cooling;

uniformly coating a layer of porous or particulate image-forming substance onto said web material thereby to provide a thermal imaging medium, said layer of image-forming substance being initially adhered to said web material sufficiently to prevent accidental dislocation; said layer of image-forming substance having a cohesive strength greater than the adhesive strength between said layer and said web material;

providing in said thermal imaging medium means for absorbing radiation rapidly at or near the interface of said image-forming surface and said layer of porous or particulate image-forming substance and for converting absorbed energy into thermal energy of sufficient intensity to liquefy said surface zone of said image-forming surface at said predetermined elevated temperature;

subjecting portions of said thermal imaging medium to exposure of brief and intense radiation sufficiently to liquefy said surface zone of liquefiable polymeric material at said predetermined elevated temperature and allowing said liquefied polymeric material to cool rapidly, thereby firmly to attach exposed portions of said porous or particulate image-forming substance to said web material; and removing from said web material those portions of said image-forming substance not exposed to said radiation by covering said layer of porous or particulate image-forming substance with a stripping sheet, after said exposure, said stripping sheet being adapted upon separation of said web material and said stripping sheet to remove said non-exposed portions with said stripping sheet; and separating said web and said stripping sheet, thereby to provide a first image comprising exposed portions of said image-forming substance firmly attached to said web and a second image on said stripping sheet comprising non-exposed portions of said image-forming substance.

17. The method of claim 16, wherein said web material is transparent to said image-forming radiation and said exposure is through said web material.

18. The method of claim 16, wherein said means for absorbing radiation at or near the interface of said image-forming surface and said image-forming substance comprises an infrared-absorbing layer interposed between said web material and said layer of image-forming substance.

19. The method of claim 16, wherein said image-forming radiation is generated by a modulated laser.

20. The method of claim 16, wherein said image-forming radiation is applied to provide an image resolution of about 1,000 dots per centimeter.

21. The method of claim 16, wherein said image-forming radiation is applied to generate a temperature of about 400° C.

22. The method of claim 16, wherein said image-forming radiation changes the viscosity of the material of said image-forming surface from about $10^{13}$ Pa.s to about $10^{-3}$ Pa.s.

* * * * *